US010563911B2

(12) United States Patent
Grant

(10) Patent No.: US 10,563,911 B2
(45) Date of Patent: Feb. 18, 2020

(54) COLD STORAGE ASSEMBLY

(71) Applicant: Suzanne Grant, Charlotte, NC (US)

(72) Inventor: Suzanne Grant, Charlotte, NC (US)

( * ) Notice: Subject to any disclaimer, the term of this patent is extended or adjusted under 35 U.S.C. 154(b) by 138 days.

(21) Appl. No.: 15/849,754

(22) Filed: Dec. 21, 2017

(65) Prior Publication Data

US 2019/0195551 A1 Jun. 27, 2019

(51) Int. Cl.

| | |
|---|---|
| ***A47F 3/00*** | (2006.01) |
| ***F25D 25/02*** | (2006.01) |
| ***F25D 29/00*** | (2006.01) |
| ***A47F 3/04*** | (2006.01) |
| ***F25D 23/02*** | (2006.01) |
| *F25D 25/04* | (2006.01) |

(52) U.S. Cl.

CPC ..... *F25D 25/024* (2013.01); *A47F 3/0434* (2013.01); *F25D 23/026* (2013.01); *F25D 29/003* (2013.01); *F25D 25/04* (2013.01); *F25D 2400/08* (2013.01)

(58) Field of Classification Search

CPC ..... A47B 51/00; A47F 3/0434; A47F 3/06; E05D 15/58; E05D 15/581; E05D 15/582; E05D 15/583

USPC ..... 312/119, 306

See application file for complete search history.

(56) References Cited

U.S. PATENT DOCUMENTS

| | | | | |
|---|---|---|---|---|
| 1,386,738 | A * | 8/1921 | Sonnenberg | E06B 3/5045 109/70 |
| 2,490,861 | A * | 12/1949 | Dunlap | F25D 25/00 254/93 R |
| 2,518,764 | A * | 8/1950 | Dunlap | F25D 25/00 108/106 |
| 4,290,529 | A | 9/1981 | Jones et al. | |
| 4,526,124 | A | 7/1985 | Hartwell | |
| 4,773,348 | A | 9/1988 | Rowley | |
| 4,823,724 | A | 4/1989 | Lumpkin | |
| 5,074,506 | A | 12/1991 | Larsen | |
| D422,390 | S | 4/2000 | Chipman | |
| D469,449 | S | 1/2003 | Andrews | |
| 8,534,212 | B1 | 9/2013 | Worsley | |
| 2002/0014086 | A1 * | 2/2002 | Holzer | A47B 77/08 62/331 |
| 2005/0109040 | A1 * | 5/2005 | Hansen | A47F 3/0434 62/3.6 |
| 2006/0038469 | A1 * | 2/2006 | Ehrlich | A47B 55/00 312/351 |
| 2006/0103273 | A1 * | 5/2006 | Lee | A47B 51/00 312/236 |

(Continued)

*Primary Examiner* — Matthew W Ing

(57) ABSTRACT

A cold storage assembly for viewing and accessing frozen goods includes a box, a cooling module, and a lid. The box defines an interior space, is insulated, and has a top that is open. The cooling module is coupled to the box is configured to lower the temperature of the interior space. A shelving module is slidably coupled to the box and is positioned in the interior space. An actuator that is operationally coupled to the shelving module is positioned to selectively lift the shelving module from the interior space so that a user is positioned to selectively position articles on the shelving module. A first window is positioned in a front of the box to allow the user to view the articles that are positioned on the shelving module within the interior space. The lid, which is insulated, is selectively couplable to the box to close the top.

14 Claims, 5 Drawing Sheets

(56) References Cited

U.S. PATENT DOCUMENTS

| | | | | |
|---|---|---|---|---|
| 2010/0018235 | A1* | 1/2010 | Simoner | A47F 3/0434 62/265 |
| 2010/0275369 | A1* | 11/2010 | Eilmus | A47J 47/005 4/631 |
| 2015/0076983 | A1* | 3/2015 | Lindblom | A47B 96/028 312/333 |
| 2018/0325257 | A1* | 11/2018 | Xiang | A47B 57/06 |

* cited by examiner

COLD STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage assemblies and more particularly pertains to a new storage assembly for viewing and accessing frozen goods.

BRIEF SUMMARY OF THE INVENTION

An embodiment of the disclosure meets the needs presented above by generally comprising a box, a cooling module, and a lid. The box defines an interior space, is insulated, and has a top that is open. The cooling module is coupled to the box is configured to lower the temperature of the interior space. A shelving module is slidably coupled to the box and is positioned in the interior space. An actuator that is operationally coupled to the shelving module is positioned to selectively lift the shelving module from the interior space so that a user is positioned to selectively position articles on the shelving module. A first window is positioned in a front of the box to allow the user to view the articles that are positioned on the shelving module within the interior space. The lid, which is insulated, is selectively couplable to the box to close the top.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
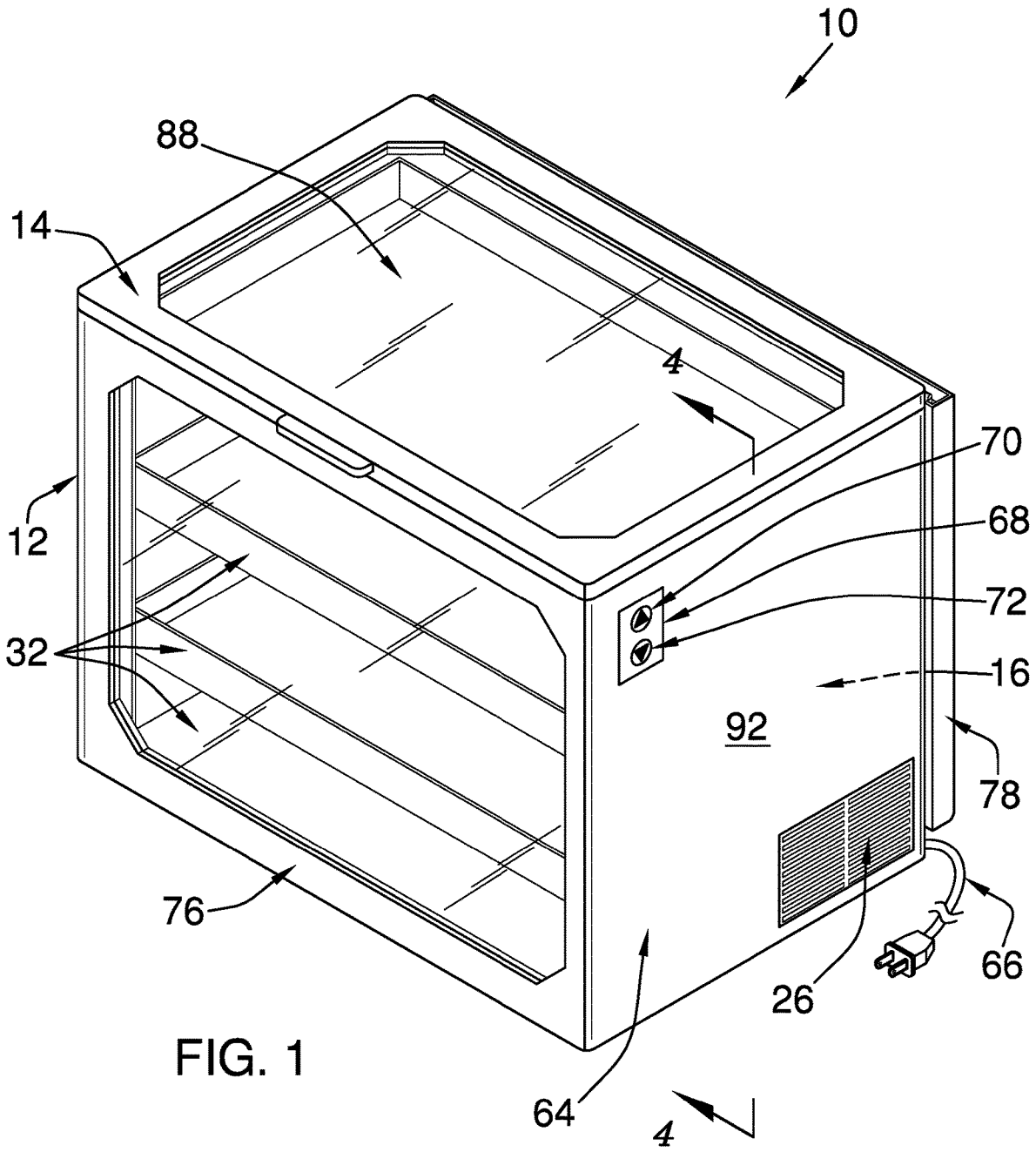
FIG. 1 is an isometric perspective view of a cold storage assembly according to an embodiment of the disclosure.

With reference now to the drawings, and in particular to FIGS. 1 through 5 thereof, a new storage assembly embodying the principles and concepts of an embodiment of the disclosure and generally designated by the reference numeral 10 will be described.

As best illustrated in FIGS. 1 through 5, the cold storage assembly 10 generally comprises a box 12 and a lid 14. The box 12 defines an interior space 16 and has a top 18 that is open. The lid 14 is selectively couplable to the box 12 to close the top 18. The box 12 and the lid 14 are insulated.

A first housing 20 is coupled to a bottom 22 of the box 12 and is positioned in the interior space 16. The first housing 20 defines a first internal space 24. The first housing 20 is insulated. A plurality of slots 26 is positioned through the box 12 adjacent to the first housing 20. The slots 26 are configured to vent the first internal space 24.

A cooling module 28 is coupled to the box 12 and is positioned in the interior space 16. The cooling module 28 is configured to lower the temperature of the interior space 16. The cooling module 28 comprises a compressor 30 and the other essential elements required for vapor-compression refrigeration, as would be obvious to one skilled in the art. The compressor 30 is coupled to the first housing 20 and is positioned in the first internal space 24. Heat generated by the compressor 30 is vented through the slots 26.

A shelving module 32 is slidably coupled to the box 12 and is positioned in the interior space 16. The shelving module 32 comprises a plurality of first panels 34 and a set of four brackets 36. The first panels 34 are rectangularly shaped. The brackets 36 are L-shaped when viewed longitudinally. The plurality of first panels 34 comprises three first panels 34. Each bracket 36 is coupled to a respective corner 38 of each first panel 34. The plurality of first panels 34 is horizontally arrayed between a lower end 40 and an upper end 42 of the shelving module 32 to define a plurality of shelves 44.

Each of a plurality of second panels 46 is coupled to and extends perpendicularly from a respective edge 48 of an associated first panel 34. The second panels 46 are positioned on the first panels 34 so that each shelf 44 is open-top box shaped.

A set of four first tracks 50 is coupled to the box 12 and is positioned in the interior space 16. The first tracks 50 are complementary to the brackets 36. The first tracks 50 are positioned in the box 12 so that each first track 50 is positioned to slidably engage an associated bracket 36.

Figure 2:
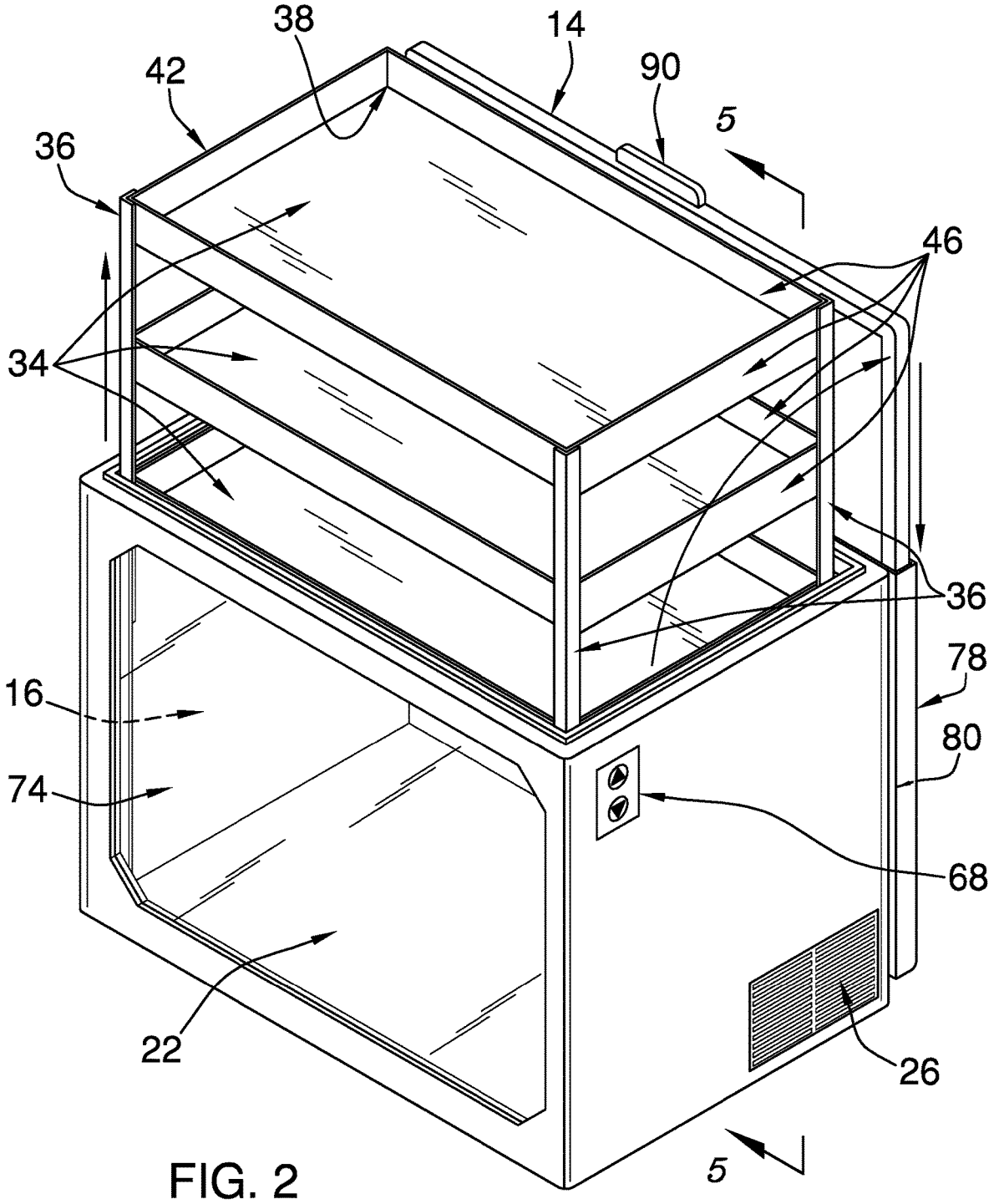
FIG. 2 is an isometric perspective view of an embodiment of the disclosure.
Figure 3:
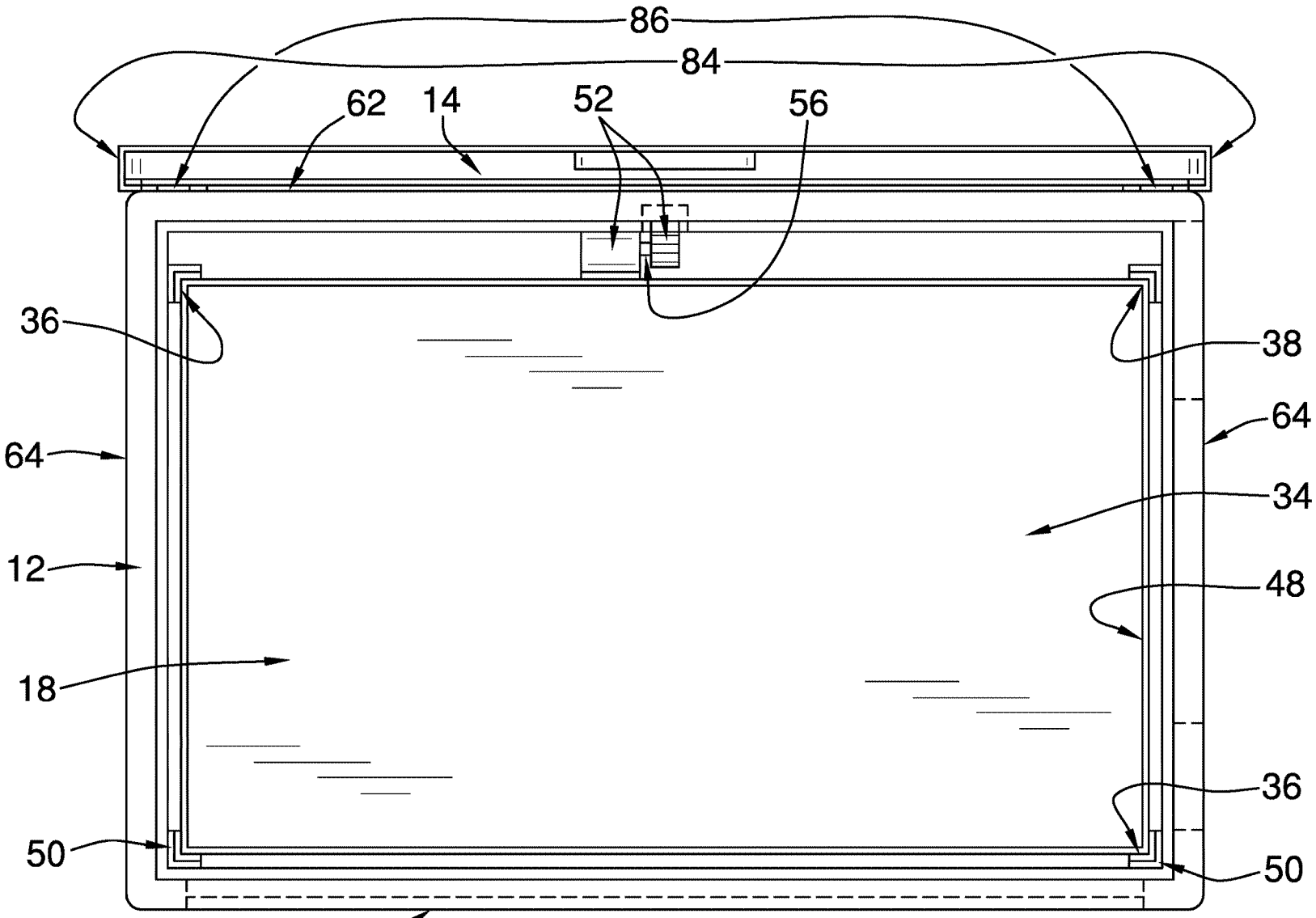
FIG. 3 is a top view of an embodiment of the disclosure.
Figure 5:
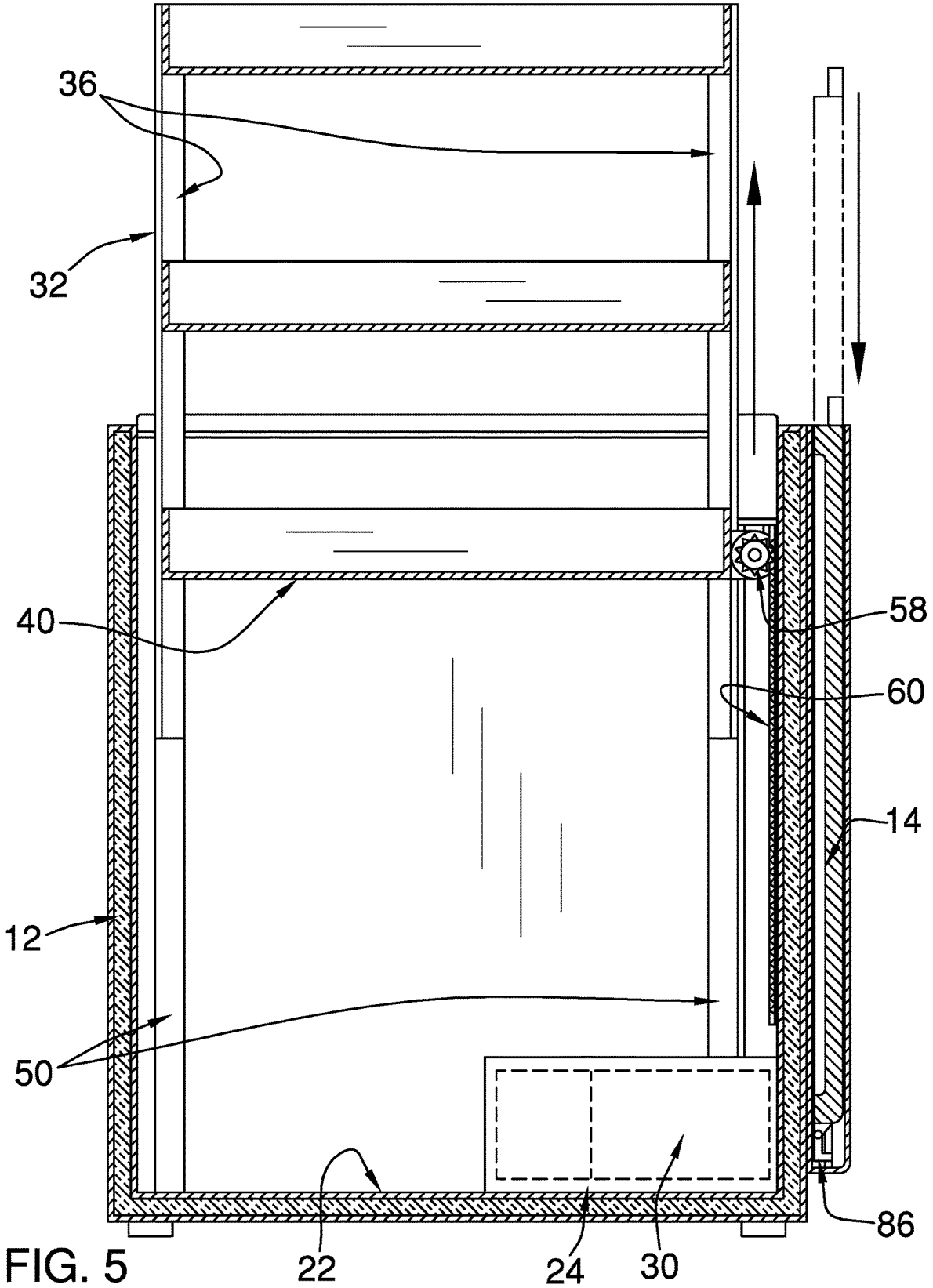
FIG. 5 is a cross-sectional view of an embodiment of the disclosure.

An actuator 52 is coupled to the box 12 and is positioned in the interior space 16. The actuator 52 is operationally coupled to the shelving module 32. The actuator 52 is positioned to selectively lift the shelving module 32 from the interior space 16 so that a user is positioned to selectively position articles on the shelving module 32, as shown in FIGS. 2 and 5.

Figure 4:
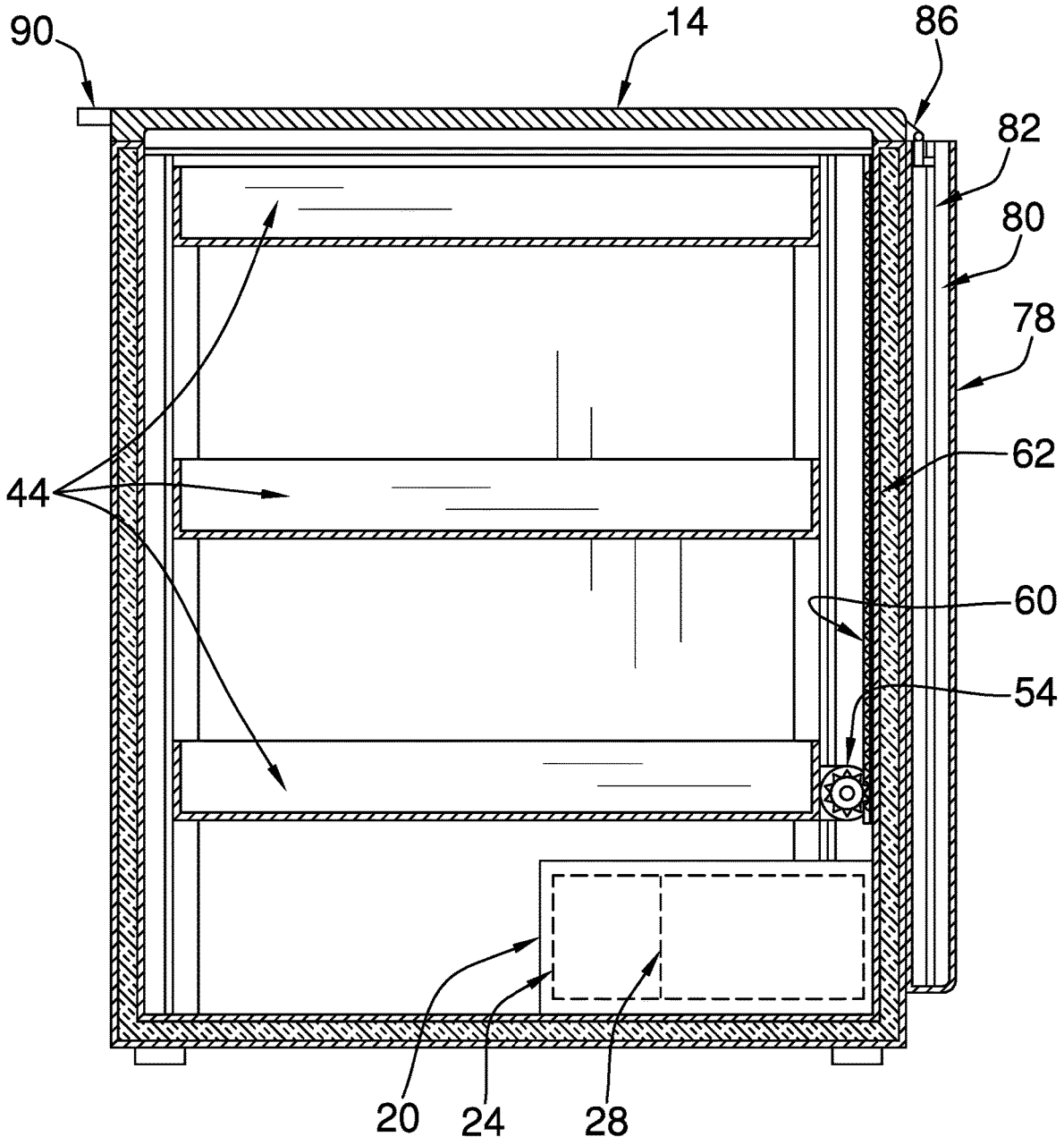
FIG. 4 is a cross-sectional view of an embodiment of the disclosure.

As shown in FIG. 4, the actuator 52 comprises a motor 54 that is coupled to the shelving module 32 adjacent to the lower end 40 of the shelving module 32. A shaft 56 is coupled to and extends from the motor 54. A pinion gear 58 is coupled to the shaft 56. A rack gear 60 is coupled to the box 12. The rack gear 60 is positioned on a back 62 of the box 12 substantially equally distant from opposing sides 64 of the box 12. The rack gear 60 is gearedly coupled to the pinion gear 58. The motor 54 is positioned to selectively rotate the pinion gear 58. The pinion gear 58 is urged vertically along the rack gear 60 to motivate the shelving module 32 vertically relative to the box 12.

A cable 66 is coupled to the box 12. The cable 66 is operationally coupled to the cooling module 28 and the actuator 52. The cable 66 is configured to couple the cooling module 28 and the actuator 52 to a source of electrical current.

A controller 68 is coupled to an exterior 92 of the box 12. The controller 68 is operationally coupled to the actuator 52 and the cable 66. The controller 68 is positioned to selectively couple the actuator 52 to the cable 66 to selectively lift the shelving module 32 from the interior space 16.

The controller 68 comprises a first button 70 and a second button 72. The first button 70 and the second button 72 are depressible. The first button 70 is configured to be depressed to selectively couple the actuator 52 to the cable 66 to lift the shelving module 32 from the interior space 16. The user is positioned to selectively position the articles on the shelving module 32. The second button 72 is configured to be depressed to selectively couple the actuator 52 to the cable 66 to lower the shelving module 32 into the interior space 16.

A first window 74 is positioned in a front 76 of the box 12. The first window 74 is configured to allow the user to view the articles that are positioned on the shelving module 32 within the interior space 16. The first window 74 is dual-paned. The first window 74 is rectangularly shaped, octagonally shaped, or the like.

A second housing 78 is coupled to the back 62 of the box 12. The second housing 78 defines a second internal space 80. The second housing 78 is open-topped. The second internal space 80 is substantially complementary to the lid 14. Each of a pair of second tracks 82 is positioned in the second internal space 80 and is coupled to a respective opposing edge 84 of the second housing 78.

Each of a pair of hinges 86 is coupled to the lid 14 and is slidably coupled to an associated second track 82. The hinges 86 are positioned on the lid 14 so that the lid 14 is positioned to pivot relative to the top 18 to open the box 12. Each hinge 86 is positioned to slide within the associated second track 82 to insert the lid 14 into the second internal space 80, as shown in FIG. 5.

An embodiment of the invention includes a second window 88 that is positioned in the lid 14, as shown in FIG. 1. The second window 88 is configured to allow the user to view the articles that are positioned on the shelving module 32 within the interior space 16. The second window 88 is dual-paned. The second window 88 is rectangularly shaped, octagonally shaped, or the like.

A handle 90 is coupled to the lid 14. The handle 90 is configured to be grasped in a hand of the user to pivot the lid 14 relative to the top 18 to open the box 12 and to selectively insert the lid 14 into the second internal space 80.

In use, the handle 90 is configured to be grasped in the hand of the user to pivot the lid 14 relative to the top 18 to open the box 12 and to selectively insert the lid 14 into the second internal space 80. The first button 70 is configured to be depressed to selectively couple the actuator 52 to the cable 66 to selectively rotate the pinion gear 58. The pinion gear 58 is urged vertically along the rack gear 60 to motivate the shelving module 32 vertically relative to the box 12. The user is positioned to selectively position the articles on the shelving module 32. The second button 72 is configured to be depressed to selectively couple the actuator 52 to the cable 66 to lower the shelving module 32 into the interior space 16. The first window 74 and the second window 88 are configured to allow the user to view the articles that are positioned on the shelving module 32 within the interior space 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cold storage assembly comprising:

a box defining an interior space, said box being insulated, said box having a top, said top being open;

a cooling module coupled to said box and positioned in said interior space, said cooling module be configured for lowering the temperature of said interior space;

a shelving module slidably coupled to said box and positioned in said interior space;

an actuator coupled to said box and positioned in said interior space, said actuator being operationally coupled to said shelving module;

a first window positioned in a front of said box;

a lid selectively couplable to said box for closing said top, said lid being insulated;

wherein said actuator is positioned in said box such that said actuator is positioned for selectively lifting said shelving module from said interior space such that a user is positioned for selectively positioning articles on said shelving module, wherein said first window is positioned in said front such that said first window is configured for viewing the articles positioned on said shelving module within said interior space;

a first housing coupled to a bottom of said box and positioned in said interior space, said first housing defining a first internal space, said first housing being insulated;

a plurality of slots positioned through said box adjacent to said first housing;

said cooling module comprising a compressor coupled to said first housing and positioned in said first internal space;

wherein said slots are positioned in said box such that said slots are configured for venting said first internal space;

a second housing coupled to a back of said box, said second housing defining a second internal space, said second housing being open-topped, said second internal space being substantially complementary to said lid;

a pair of second tracks, each said second track being positioned in said second internal space and coupled to a respective opposing edge of said second housing;

a pair of hinges, each said hinge being coupled to said lid and slidably coupled to an associated said second track; and wherein said hinges are positioned on said lid such that said lid is positioned for pivoting relative to said top for opening said box, such that each said hinge is positioned for sliding within said associated said second track such that said lid is inserted into said second internal space.

2. The assembly of claim 1, further comprising:

said shelving module comprising:

a plurality of first panels, said first panels being rectangularly shaped, and a set of four brackets, said brackets being L-shaped when viewed longitudinally, each said bracket being coupled to a respective corner of each said first panel, said plurality of first panels being horizontally arrayed between a lower end and an upper end of said shelving module defining a plurality of shelves;

a set of four first tracks coupled to said box and positioned in said interior space, said first tracks being complementary to said brackets; and wherein said first tracks are positioned in said box such that each said first track is positioned for slidably engaging an associated said bracket.

3. The assembly of claim 2, further including said plurality of first panels comprising three said first panels.

4. The assembly of claim 3, further including a plurality of second panels, each said second panel being coupled to and extending perpendicularly from a respective edge of an associated said first panel, wherein said second panels are positioned on said first panels such that each said shelf is open-top box shaped.

5. The assembly of claim 1, further including said actuator comprising:

a motor coupled to said shelving module adjacent to a lower end of said shelving module;

a shaft coupled to and extending from said motor;

a pinion gear coupled to said shaft;

a rack gear coupled to said box, said rack gear being gearedly coupled to said pinion gear; and wherein said pinion gear is positioned on said shaft such that said motor is positioned for selectively rotating said pinion gear such that said pinion gear is urged vertically along said rack gear for motivating said shelving module vertically relative to said box.

6. The assembly of claim 5, further including said rack gear being positioned on a back of said box substantially equally distant from opposing sides of said box.

7. The assembly of claim 1, further comprising:

a cable coupled to said box, said cable being operationally coupled to said cooling module and said actuator, said cable being configured for coupling said cooling module and said actuator to a source of electrical current;

a controller coupled to an exterior of said box, said controller being operationally coupled to said actuator and said cable; and wherein said controller is positioned on said box such that said controller is positioned for selectively coupling said actuator to said cable for selectively lifting said shelving module from said interior space.

8. The assembly of claim 7, further including said controller comprising a first button and a second button, said first button and said second button being depressible, wherein said first button is positioned on said box such that said first button is configured for depressing for selectively coupling said actuator to said cable for lifting said shelving module from said interior space such that the user is positioned for selectively positioning the articles on said shelving module, wherein said second button is positioned on said box such that said second button is configured for depressing for selectively coupling said actuator to said cable for lowering said shelving module into said interior space.

9. The assembly of claim 1, further including said first window being dual-paned, said first window being rectangularly shaped.

10. The assembly of claim 9, further including said first window being octagonally shaped.

11. The assembly of claim 1, further including a second window positioned in said lid, wherein said second window is positioned in said lid such that said second window is configured for viewing of the articles positioned on said shelving module positioned in said interior space, said second window being dual-paned, said second window being rectangularly shaped.

12. The assembly of claim 11, further including said second window being octagonally shaped.

13. The assembly of claim 1, further including a handle coupled to said lid, wherein said handle is positioned on said lid such that said handle is configured for grasping in a hand of the user for pivoting said lid relative to said top for opening said box and for selectively inserting said lid into said second internal space.

14. A cold storage assembly comprising:

a box defining an interior space, said box being insulated, said box having a top, said top being open;

a first housing coupled to a bottom of said box and positioned in said interior space, said first housing defining a first internal space, said first housing being insulated;

a plurality of slots positioned through said box adjacent to said first housing, wherein said slots are positioned in said box such that said slots are configured for venting said first internal space;

a cooling module coupled to said box and positioned in said interior space, said cooling module be configured for lowering the temperature of said interior space, said cooling module comprising a compressor coupled to said first housing and positioned in said first internal space;

a shelving module slidably coupled to said box and positioned in said interior space, said shelving module comprising:

a plurality of first panels, said first panels being rectangularly shaped, said plurality of first panels comprising three said first panels, a set of four brackets, said brackets being L-shaped when viewed longitudinally, each said bracket being coupled to a respective corner of each said first panel, said plurality of first panels being horizontally arrayed between a lower end and an upper end of said shelving module defining a plurality of shelves, and a plurality of second panels, each said second panel being coupled to and extending perpendicularly from a respective edge of an associated said first panel, wherein said second panels are positioned on said first panels such that each said shelf is open-top box shaped;

a set of four first tracks coupled to said box and positioned in said interior space, said first tracks being complementary to said brackets, wherein said first tracks are positioned in said box such that each said first track is positioned for slidably engaging an associated said bracket;

an actuator coupled to said box and positioned in said interior space, said actuator being operationally coupled to said shelving module, wherein said actuator is positioned in said box such that said actuator is positioned for selectively lifting said shelving module from said interior space such that a user is positioned for selectively positioning articles on said shelving module, said actuator comprising:

a motor coupled to said shelving module adjacent to said lower end of said shelving module, a shaft coupled to and extending from said motor, a pinion gear coupled to said shaft, and a rack gear coupled to said box, said rack gear being gearedly coupled to said pinion gear, wherein said pinion gear is positioned on said shaft such that said motor is positioned for selectively rotating said pinion gear such that said pinion gear is urged vertically along said rack gear for motivating said shelving module vertically relative to said box, said rack gear being positioned on a back of said box substantially equally distant from opposing sides of said box;

a cable coupled to said box, said cable being operationally coupled to said cooling module and said actuator, said cable being configured for coupling said cooling module and said actuator to a source of electrical current;

a controller coupled to an exterior of said box, said controller being operationally coupled to said actuator and said cable, wherein said controller is positioned on said box such that said controller is positioned for selectively coupling said actuator to said cable for selectively lifting said shelving module from said interior space, said controller comprising a first button and a second button, said first button and said second button being depressible, wherein said first button is positioned on said box such that said first button is configured for depressing for selectively coupling said actuator to said cable for lifting said shelving module from said interior space such that the user is positioned for selectively positioning the articles on said shelving module, wherein said second button is positioned on said box such that said second button is configured for depressing for selectively coupling said actuator to said cable for lowering said shelving module into said interior space;

a first window positioned in a front of said box, wherein said first window is positioned in said front such that said first window is configured for viewing the articles positioned on said shelving module within said interior space, said first window being dual-paned, said first window being rectangularly shaped, said first window being octagonally shaped;

a lid selectively couplable to said box for closing said top, said lid being insulated;

a second housing coupled to said back of said box, said second housing defining a second internal space, said second housing being open-topped, said second internal space being substantially complementary to said lid;

a pair of second tracks, each said second track being positioned in said second internal space and coupled to a respective opposing edge of said second housing;

a pair of hinges, each said hinge being coupled to said lid and slidably coupled to an associated said second track, wherein said hinges are positioned on said lid such that said lid is positioned for pivoting relative to said top for opening said box, such that each said hinge is positioned for sliding within said associated said second track such that said lid is inserted into said second internal space;

a second window positioned in said lid, wherein said second window is positioned in said lid such that said second window is configured for viewing the articles positioned on said shelving module positioned in said interior space, said second window being dual-paned, said second window being rectangularly shaped, said second window being octagonally shaped;

a handle coupled to said lid, wherein said handle is positioned on said lid such that said handle is configured for grasping in a hand of the user for pivoting said lid relative to said top for opening said box and for selectively inserting said lid into said second internal space; and wherein said handle is positioned on said lid such that said handle is configured for grasping in the hand of the user for pivoting said lid relative to said top for opening said box and for selectively inserting said lid into said second internal space, wherein said first button is positioned on said box such that said first button is configured for depressing for selectively coupling said actuator to said cable for selectively rotating said pinion gear such that said pinion gear is urged vertically along said rack gear for motivating said shelving module vertically relative to said box such that the user is positioned for selectively positioning the articles on said shelving module, wherein said second button is positioned on said box such that said second button is configured for depressing for selectively coupling said actuator to said cable for lowering said shelving module into said interior space, wherein said first window is positioned in said front and said second window is positioned in said lid such that said first window and said second window are configured for viewing the articles positioned on said shelving module within said interior space.

* * * * *